US005844252A

United States Patent [19]

Shiomi et al.

[11] Patent Number: 5,844,252

[45] Date of Patent: Dec. 1, 1998

[54] FIELD EMISSION DEVICES HAVING DIAMOND FIELD EMITTER, METHODS FOR MAKING SAME, AND METHODS FOR FABRICATING POROUS DIAMOND

[75] Inventors: Hiromu Shiomi; Yoshiki Nishibayashi; Tadashi Tomikawa; Shin-ichi Shikata, all of Itami, Japan

[73] Assignee: Sumitomo Electric Industries, Ltd., Japan

[21] Appl. No.: 690,173

[22] Filed: Jul. 25, 1996

Related U.S. Application Data

[63] Continuation-in-part of Ser. No. 311,463, Sep. 22, 1994, Pat. No. 5,552,613.

[30] Foreign Application Priority Data

Sep. 24, 1993 [JP] Japan ..... 5-238571
Jul. 27, 1995 [JP] Japan ..... 7-211089

[51] Int. Cl.[6] ..... H01J 1/02; H01J 1/14

[52] U.S. Cl. ..... 257/10; 257/77; 313/309; 313/355

[58] Field of Search ..... 257/10, 77; 156/643, 156/647, 655; 427/249, 255; 313/309, 355

[56] References Cited

U.S. PATENT DOCUMENTS 4,957,591 9/1990 Sato et al. ..... 156/643
5,138,237 8/1992 Kane et al. ..... 156/643
5,341,063 8/1994 Kumar ..... 156/643
5,399,238 3/1995 Kumar ..... 156/643
5,449,435 9/1995 Ageno et al. ..... 156/657

FOREIGN PATENT DOCUMENTS

A-0 523 494 1/1993 European Pat. Off. ..... 156/643
WO 93/15522 8/1993 WIPO ..... 156/643

OTHER PUBLICATIONS

Geis et al., "Diamond Cold Cathode", IEEE Electron Device Letters, vol. 12, No., 8, Aug. 1, 1991, pp. 456–459.
J.F. Prins, "Bipolar transistor action in ion implanted diamond", Applied Physics Letters, vol. 41, No. 10, Nov. 15, 1982, pp. 950–052.
Okano et al., "Fabrication of a diamond field emitter array", Appl. Phys. Lett. 64 (20), 16 May 1994.

*Primary Examiner*—Donald Monin
*Attorney, Agent, or Firm*—Pennie & Edmonds LLP

[57] ABSTRACT

A field emission device according to the present invention comprises a support substrate; a cathode mounted on a surface of said support substrate; a first diamond portion located on any surface of said substrate, said first diamond portion substantially having an electrical connection with said cathode; a second diamond portion located on the substrate surface on which said first diamond portion is also located, said second diamond portion including plurality of diamond protuberances; and an anode positioned spaced apart from said first and second diamond portions, wherein a space is formed between said anode and said second diamond portion.

8 Claims, 7 Drawing Sheets

FIELD EMISSION DEVICES HAVING DIAMOND FIELD EMITTER, METHODS FOR MAKING SAME, AND METHODS FOR FABRICATING POROUS DIAMOND

RELATED APPLICATIONS

This is a continuation-in-part of application Ser. No. 08/311,463 filed Sep. 22, 1994 now U.S. Pat. No. 5,552,613.

BACKGROUND OF THE INVENTION

1. Field of the Invention

The present invention is directed to a field emission devices (FEDs) which include diamond field emitter. The present invention is also directed to methods for fabricating porous diamond, which is applicable to the use as a field emitter.

2. Related Background Art

The conventional basic electronic devices such as bipolar transistors or FETs often have problems in the operation with higher voltage or at elevated temperature, since such conventional basic devices generally have insufficient withstand voltage, or poor thermal properties. The insufficiencies in the withstand voltage or the thermal properties, in principal, come from the nature of electronic device materials. Thus, it is desirable to fabricate improved electronic devices with specified electronic device materials which has improved withstand voltage and thermal properties.

Diamond is widely recognized to be desirable material for achieving improved withstand voltage and thermal properties of the electronic devices. It is also widely known that Diamond has excellent electron emitting characteristics. Such technical aspects are generally described by, for example, Himpsel (Himpsel, F. J., Phys. Rev. B20(1979), 634) and Geis (Geis, M. W., IEEE Trans. Electron Devices 38(1991), 619).

Diamond is an advantageous material for fabricating field emission devices, because of these features, and in particular, of excellent electron emission characteristics.

Variety of field emission devices are disclosed in, for example, Okano, K,., et.al., Appl. Phys. Lett., 64(20), 16 May 1994, U.S. Pat. No. 5,399,238 to Kumar, and U.S. Pat. No. 5,449,435 to Ageno et.al.

The field emission devices of these references include electron emitters that have at least one geometric discontinuity of a small radius of curvature such as a sharp tip or sharp edge, which is made of semiconductor materials such as diamond or silicon. The preparing method of "needle-like" or porous diamond having tips or protuberances is disclosed in, for example, U.S. Pat. No. 4,957,591 to Sato et.al.

The FEDs also have an extraction electrode that is proximally disposed with reference to the electron emitter. The extraction electrode and the electron emitter are set in a vacuum container. An appropriate potential is applied between the electron emitter and the extraction electrode, so that electrons are emitted from the electron emitter into substantially vacuum space toward the extraction electrode. The electron emission characteristics of the field emitter material is very important, and diamond is preferable material for field emitter which emits electrons.

In order to further improve the electron emission characteristics of the diamond, it is preferable to make larger surface area of the field emitter as possible. That is, the diamond field emitter preferably has larger number of diamond protuberances or diamond electron emitting cones, and the diamond protuberances is preferably as acute and thin as possible. Alternatively, the diamond protuberances in the diamond field emitter preferably have higher aspect ratio, so that the diamond field emitter has larger surface area for electron emission.

SUMMARY OF THE INVENTION

The applicants have made significant efforts to achieve an increased emission current, an increased current gain and increased withstand voltage of the electron devices. Following four electron devices have been obtained.

The first electron device comprises an i-type diamond layer formed on a substrate, and an n-type diamond layer formed on the i-type diamond layer and having a first surface region and a second surface region, which are set in a vacuum container, wherein the first surface region is formed as being flat and the second surface region is formed to have an emitter portion having a bottom area of not more than a 10 $\mu$m square and formed of the n-type diamond layer, the emitter portion projecting relative to the first surface region.

A second electron device comprises an i-type substrate formed to have a first surface region and a second surface region, an i-type diamond layer formed in the second surface region, an n-type diamond layer formed on the i-type diamond layer, and a wiring layer formed in the first surface region so as to be connected with the n-type diamond layer, which are set in a vacuum container, wherein the first surface region is formed as being flat and the second surface region is formed to have an emitter portion having a bottom area of not more than a 10 $\mu$m square and formed of the i-type diamond layer and the n-type diamond layer, the emitter portion projecting relative to the first surface region.

A third electron device comprises an i-type diamond layer formed on a substrate, and at least one n-type diamond layer formed on the i-type diamond layer and having a first surface region and a plurality of second surface regions, which are set in a vacuum container, wherein the first surface region is formed as being flat and the plurality of second surface regions are formed to have a plurality of emitter portions each having a bottom area of not more than a 10 $\mu$m square and being formed of the n-type diamond layer, the emitter portions being arranged in a two-dimensional array so as to project relative to the first surface region.

Further, a fourth electron device comprises an i-type substrate formed to have a first surface region and a plurality of second surface regions, a plurality of i-type diamond layers formed in the plurality of respective second surface regions, a plurality of n-type diamond layers formed on the plurality of respective i-type diamond layers, and at least one wiring layer formed in the first surface region so as to be connected with the n-type diamond layers, which are set in a vacuum container, wherein the first surface region is formed as being flat and the plurality of second surface regions are formed to have a plurality of emitter portions each having a bottom area of not more than a 10 $\mu$m square and formed of the i-type diamond layer and the n-type diamond layer, the emitter portions projecting relative to the first surface region.

The embodiment may be so arranged that an insulting layer and an electrode layer are successively layered further in the first surface region.

In the embodiment, the emitter portion may be formed with a height 1/10 or more of the minimum width in the second surface region with respect to the first surface region.

An n-type dopant in the n-type diamond layer may be nitrogen. Specifically, a dopant concentration of nitrogen in the n-type diamond layer is preferably not less than $1\times10^{19}$ $cm^{-3}$. The dopant concentration of nitrogen in the n-type diamond layer is preferably more than a dopant concentration of boron and not more than 100 times the dopant concentration of boron. The dopant concentration of nitrogen in the n-type diamond layer is more preferably more than the dopant concentration of boron and not more than 10 times the dopant concentration of boron.

In the first and third electron devices, the n-type diamond layer is formed on the i-type diamond layer while having a flat surface as the first surface region, and the one emitter portion or the plurality of emitter portions each having the bottom area of not more than the 10 $\mu$m square are formed in the second surface region(s) so as to project relative to the first surface region.

In the second and fourth electron devices, the i-type substrate is formed to have the flat surface as the first surface region, and the second surface region in the i-type substrate has the one emitter portion or the plurality of emitter portions in the lamination structure of the i-type diamond layer and the n-type diamond layer and with the bottom area of not more than the 10 $\mu$m square, formed so as to project relative to the first surface region.

Diamond forming the n-type diamond layer has a value of electron affinity which is very close to zero, whereby a difference is fine between the conduction band and the vacuum level.

The present inventors presumed that electrons could be readily taken out into the vacuum by supplying a current thereof in diamond. Then, the present inventors verified that electrons were emitted with a very high efficiency into the vacuum by the field emission with the n-type diamond layer doped with nitrogen as the n-type dopant in a high concentration or further doped with boron in accordance with the dopant concentration of nitrogen. Since the n-type diamond layer is doped with the n-type dopant in a high concentration, the donor levels are degenerated near the conduction band, so that metal conduction is dominant as conduction of electrons.

Thus, increasing the temperature of the substrate to about 300° to about 600° C., generating an electric field near the surface of the emitter portion, and supplying an electric current to the n-type diamond layer or the wiring layer connected with the emitter portion, electrons are emitted with a high efficiency from the tip of the emitter portion into the vacuum. Where the dopant concentration of nitrogen in the n-type diamond layer is high enough, electrons can be emitted with a high efficiency from the tip of the emitter portion by the field emission even if the temperature of the substrate is about the room temperature.

Thus, if the emitter portion made of n-type diamond has the bottom area of not more than the 10 $\mu$m square in the second surface region and projects relative to the first surface region even though the tip thereof is not very fine, electrons can be readily taken out into the vacuum by the field emission with a relatively small field strength.

If the insulating layer and electrode layer are successively layered further in the first surface region in the i-type diamond layer or the i-type substrate, electrons emitted from the emitter portion are captured by the electrode layer to be detected.

A field emission device according to the present invention is achieved on the basis of the above four electron devices, and comprises a support substrate; a cathode mounted on a surface of said support substrate; a first diamond portion located on any surface of said substrate, said first diamond portion substantially having an electrical connection with said cathode; a second diamond portion located on the substrate surface on which said first diamond portion is also located, said second diamond portion including plurality of diamond protuberances; and an anode positioned spaced apart from said first and second diamond portions, wherein a space is formed between said anode and said second diamond portion.

The electron device according to the present invention has a field emitter which comprises a number of diamond emitting protuberances formed on generally flat surface of the substrate. Further, each of the protuberances has higher aspect ratio, so that the field emitter has larger surface area. Therefore, electron device according to the present invention has improved characteristics of electron emission.

A method for fabricating a field emission device according to the present invention comprises: forming a diamond layer onto a support substrate via a vapor phase synthesis; etching a portion of said diamond layer to form a first diamond portion which is not etched and a second diamond portion having plurality of protuberances; forming an anode positioned spaced apart from said first and second diamond portions, wherein a space is formed between said anode and said second diamond portion.

The method for fabricating the electron device according to the present invention generally comprises selectively etching a diamond surface at the internal defects inherently contained in the diamond, thereby providing diamond field emitter having a number of thinner diamond protuberances. The reactive ion etch (RIE) is preferably employed for the etch step, so that the higher anisotropy of RIE provides thinner protuberances.

A method for fabricating a porous diamond which has plurality of diamond protuberances, according to the present invention comprises: etching a diamond material by exposing a plasma generated from etch gases comprising 10–100% vol. of oxygen gas ($O_2$) to obtain the porous diamond having plurality of diamond protuberances, said plasma having plasma potential of 10 volts or more. Alternatively, the etch gases may comprise oxygen-containing gas such as $CO_2$, $N_2O$ or CO.

Alternatively, the etch gas may comprise nitrogen gas ($N_2$), or other nitrogen-containing gas such as ammonia ($NH_3$).

The present invention will become more fully understood from the detailed description given hereinbelow and the accompanying drawings which are given by way of illustration only, and thus are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

These and other features, aspects, and advantages of the present invention will become better understood with reference to the following description, appended claims, and accompanying drawings, where:

DESCRIPTION OF THE PREFERRED EMBODIMENTS

The present invention will be described in more detail.

(Diamond)

The field emission devices according to the present invention can be fabricated with either a natural diamond or a synthesis diamond. It is more preferable to employ vapor phase-synthesized diamond, in order to obtain desirable electric conductivity. (Method for forming emitting protuberances/cones)

The emitting protuberances or emitting cones/cylinders can typically be created by anisotropic etching of the diamond layer which have been formed onto the substrate. The diamond layer is etched at internal defects such as atomic vacancies or dislocations, which inherently exist in the crystal of the diamond. The etching may also be taken place at grain boundaries of polycrystalline diamond, as well as at the internal defects.

It is preferable to create electron emitting protuberances or emitting tips having smaller bottom area of and higher aspect ratio, by anisotropically etching at the internal defects which are exposed on the diamond surface. This method can provide diamond field emitter that includes a large number of electron emitting protuberances, each of which has a dimension that can be enclosed within a virtual cylinder having diameter of 1 $\mu$m and height of 5 $\mu$m.

If the diamond is etched only at inter-grain boundaries, the resultant protuberances would have much larger dimension, and a limited number of protuberances can be included within the prescribed small area of field emitter. Aforementioned U.S. Pat. No. 4,957,591 to Sato et.al. describes that the diamond is etched only at the inter-grain boundaries, thereby forming protuberances which have relatively large dimensions. The field emission device according to the present invention has diamond field emitter that has a large number of protuberances within the prescribed small area, each of which has smaller dimension that is included within a virtual cylinder having diameter of at least 1 $\mu$m, preferably 0.1 $\mu$m, and height of 5 $\mu$m, because the etching at internal defects of single diamond grain can be achieved according to the present invention.

(DEVICES)

The field emission devices according to the present invention can be used for various electron devices such as rectifier devices, electric power amplifiers, electric current amplifiers, switches, in particular high-frequency switches, flat panel displays, scanning electron microscopes, and electron guns. These application can be provided with improved withstanding voltage and thermal properties, by having diamond field emitters according to the present invention.

EXAMPLES

Example 1

Figure 1:
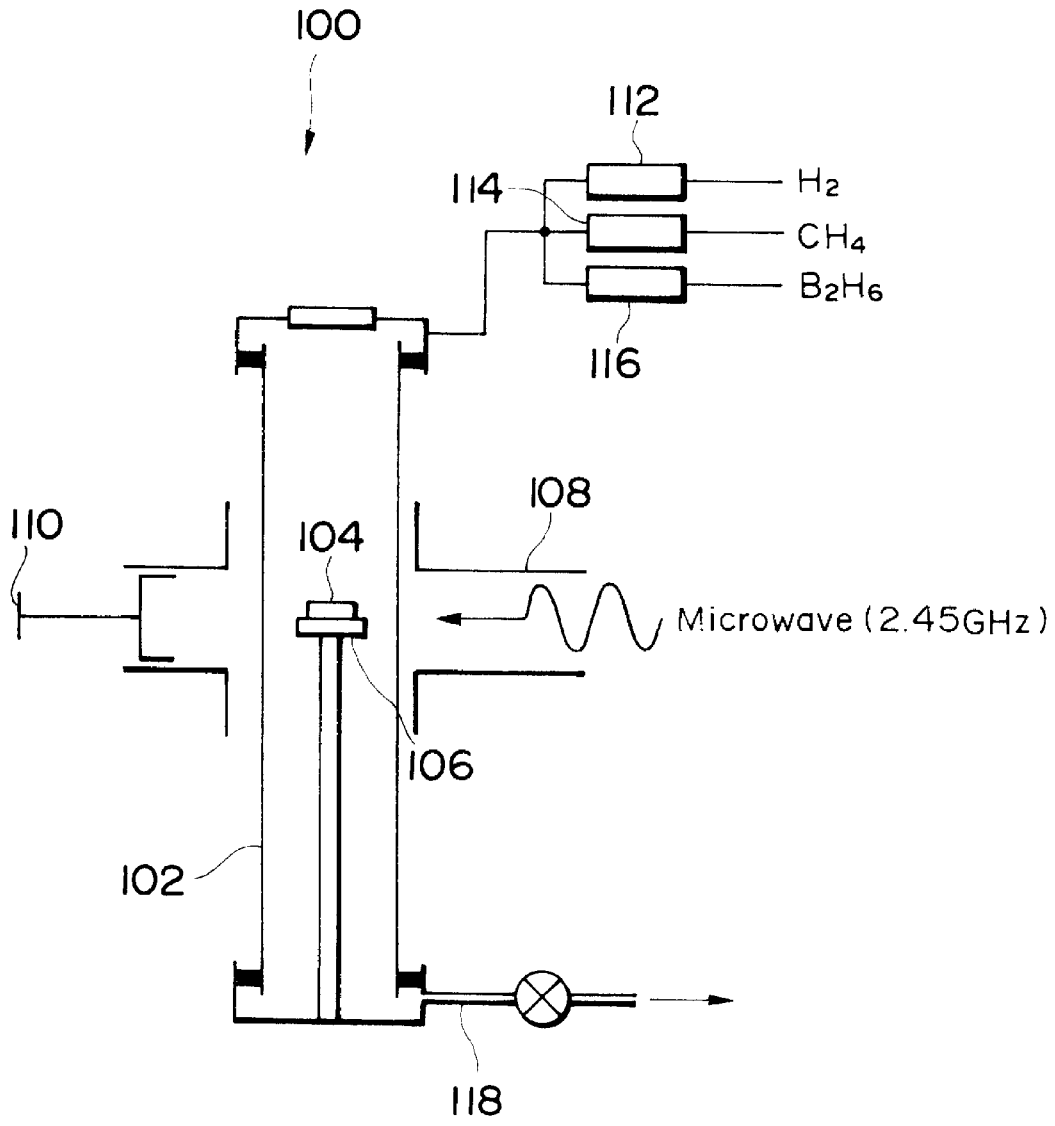
FIG. 1 is a schematic illustration of a micro wave plasma CVD apparatus suitable for using in the present invention.

FIG. 1 schematically illustrates a preferable microwave plasma CVD (chemical vapor deposition) apparatus suitable for the use in the present invention. As shown in FIG. 1, a microwave plasma CVD apparatus 100 includes a vacuum chamber 102, in which a substrate holder 106 for holding substrate 104 is mounted. Chamber 104 has a waveguide tube 108 for introducing microwave of 2.45 GHz to an area adjacent to substrate 104. Chamber 104 also has a plunger 110 to prevent creating of standing wave within chamber 104 so that plasma can be formed within chamber 104 without contacting chamber walls. Substrate 104 is horizontally held on substrate holder 106, and reactive gases such as methane and hydrogen are supplied toward the upper surface of substrate 104. In the present example, there is provided gas suppliers 112, 114 and 116, for supplying hydrogen gas ($H_2$), methane gas ($CH_4$) and diborane gas ($B_2H_6$), respectively, at separate flow rates. The reactive gases introduced from the upper portion of chamber 104 can be ionized to form plasma around substrate holder 106, which deposits desired material onto substrate 104. The consumed gases are drawn through exhaust port 118 at the bottom portion of chamber 104.

FIGS. 2A to 2F are cross-sectional view of devices fabricated in the present example, which schematically illustrate the manufacturing steps of the present example. In the present example, microwave plasma CVD apparatus 100 shown in FIG. 1 was used to form electric device via a sequence of manufacturing steps, which correspond to FIGS. 2A to 2F, respectively.

An Si(100) substrate 10 having thickness of 300 $\mu$m was mounted onto the substrate holder within the microwave plasma CVD apparatus, which is shown in FIG. 1.

Figure 2A:
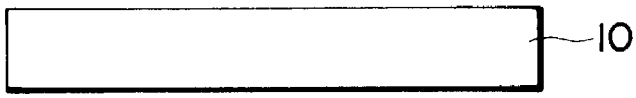
FIGS. 2A–2F are cross-sectional view of devices fabricated in the preferred embodiment.
Figure 2B:
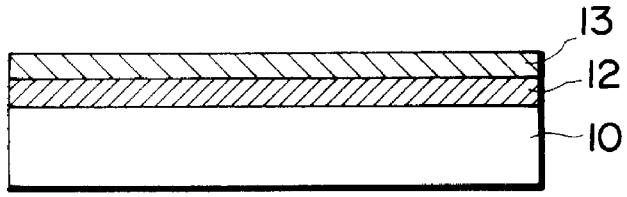

Boron doped diamond layer 12 was deposited on the upper surface of substrate 10, and undoped diamond layer 13 was then deposited on the surface of boron doped layer 12 (see FIG. 2B). These layers were to be partially etched, as described later, to form electron emission portions. The remaining portions of the undoped diamond layer 13 is to function as insulating layers between substrate and gate electrodes. The deposition of these diamond layers were performed by the deposition process, that comprises a first deposition step for forming doped layer and a second deposition step for forming undoped layer, process conditions of which are shown below:

Hydrogen gas ($H_2$) flow rate: 200 sccm;

Methane gas ($CH_4$) flow rate: 1 sccm;

Diborane gas ($B_2H_6$) flow rate:

10 sccm for the first step for doped layer, and 0 for the second step for undoped layer;

($B_2H_6$ was diluted with $H_2$ to have conc. of 100 ppm)

Pressure: 40 Torr;

Microwave frequency: 2.45 GHz;

Microwave Power: 300 W;

Substrate Temperature: 940° C.

Duration:

1 hr for the first step for doped layer, and 1 hr for the second step for undoped layer.

The deposition steps were performed to form boron doped diamond layer 12 having thickness of 1 $\mu$m and undoped diamond layer 13 having thickness of 1 $\mu$m. Both of deposited doped and undoped layers 12 and 13 were formed of polycrystalline diamond. The boron concentration of boron doped layer 12 was measured by SIMS (secondary ion mass spectroscopy) to obtain 100 ppm.

Figure 2C:
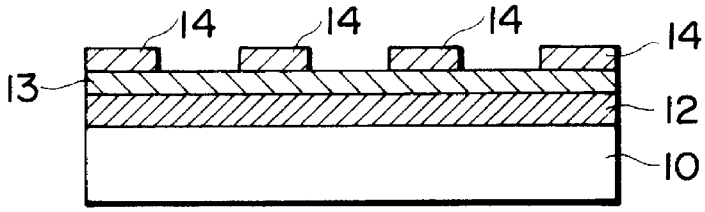

Then substrate 10 having diamond layers 12 and 13, shown in FIG. 2B, was removed from the microwave plasma apparatus, and transferred to a metal film deposition apparatus for depositing aluminum (Al) layer. The deposited aluminum layer was then patterned by using a conventional photolithography technology, to form patterned aluminum layers 14 (FIG. 2C). Patterned aluminum layers 14 were to serve as masks for subsequent etching step, as well as functioning gate electrodes of finished device.

Figure 2D:
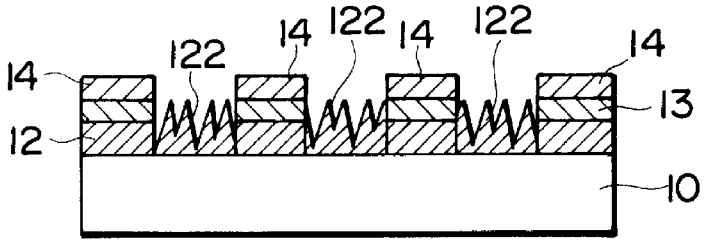

Next, diamond layers 12 and 13 were etched to form electron emission portions 122 which comprises a number of protuberances, as shown in FIG. 2D.

The substrate shown in FIG. 2C was transferred to a dry etching apparatus, and the diamond layer on the substrate was reactive ion-etched (RIE) under the following condition:

Etching gas: $O_2$ 100%;

RF power: 500 W;

Pressure: 0.05 Torr;

Duration: 1 hr;

Mean etching depth: 1.2 $\mu$m.

Figure 3:
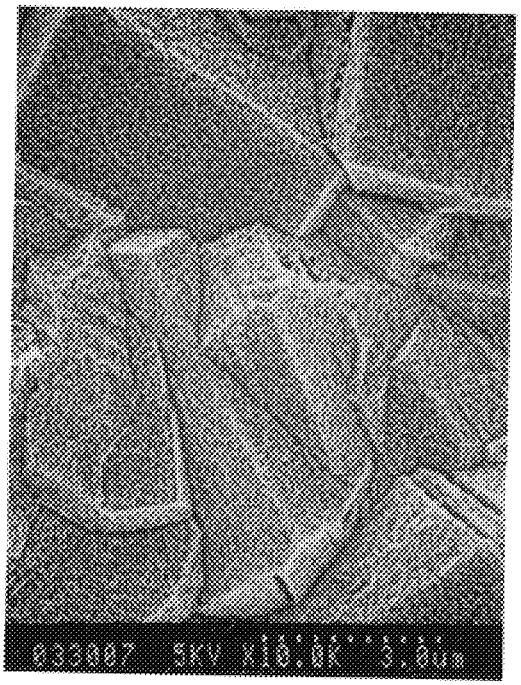
FIG. 3 is a SEM photograph showing a diamond surface of an initial etch stage.

(The "mean etching depth" represents resultant etching depth, because the height of protuberances varies, as shown in FIG. 3)

As described before, boron doped diamond layer 12 formed onto Si (100) substrate 10 is polycrystalline, and thus, undoped diamond layer 13 formed on polycrystalline diamond 12 is also polycrystalline. The exposed surface of undoped diamond layer 13 includes a large number of internal defects within any single diamond grain of the polycrystalline diamond. The internal defects exposed on the diamond surface are selectively etched under the etching condition shown above. The selective etching results in creating electron emission portions 122 which comprises a larger number of diamond protuberances, each of which has smaller dimension that is included within a virtual cylinder having diameter of 1 $\mu$m and height of 5 $\mu$m, as schematically illustrated in FIG. 2D. The electron emission portions 122 would function as field emitters, when it is contained within a vacuum container.

The instant example utilizes the reactive ion etch (RIE), that can provide highly anisotropic etching. Therefore, the electron emitting protuberances formed via reactive ion etch have higher aspect ratio. For example, the electron emitting cones formed via above etching condition may have an average aspect ratio (height/bottom diameter) of more than 5.

The etch selectivity of diamond over aluminum is very high, because 100% $O_2$ gas is used as the etch gas in this example. Shikata et.al. discloses the etch selectivity of diamond:aluminum for RIE that utilizes $O_2$/Ar gases as etch gas ("MICROFABRICATION TECHNIQUE FOR DIAMOND DEVICES", Shikata, S., et.al., 2nd International Conference on the Application of Diamond Films and Related Materials, 1993, Tokyo Japan). The reference describes that higher $O_2$ concentration in etch gases gives higher diamond:aluminum selectivity.

Figure 4:
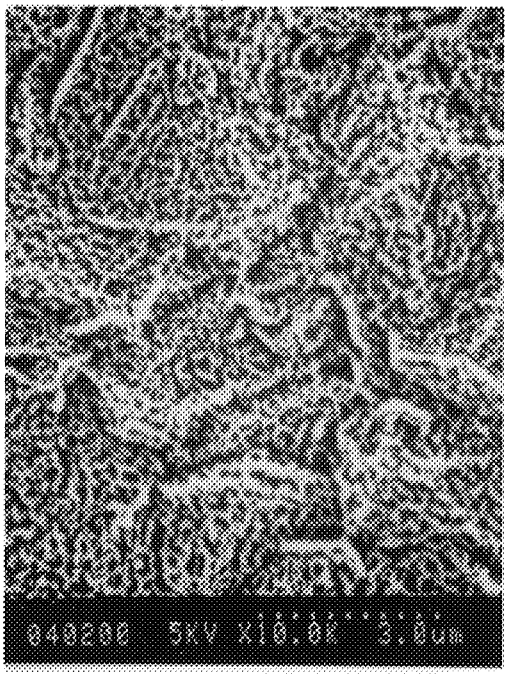
FIG. 4 is a SEM photograph, showing diamond surface on which selective etch have been proceeded at internal defects.
Figure 5A:
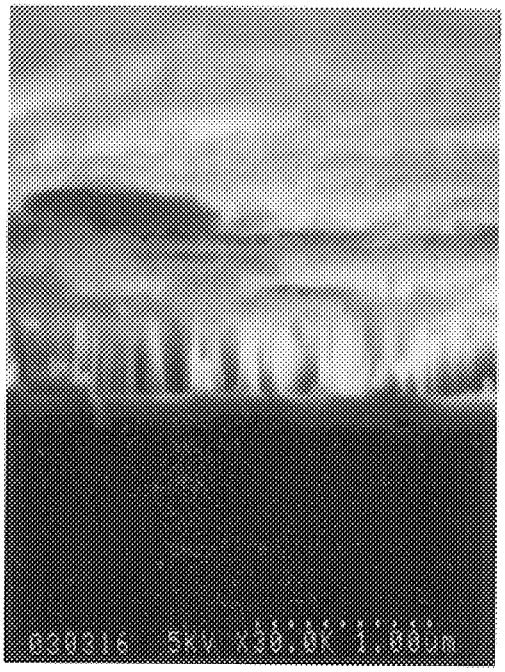
FIG. 5A is a SEM photograph, showing side view of the diamond protuberances.
Figure 5B:
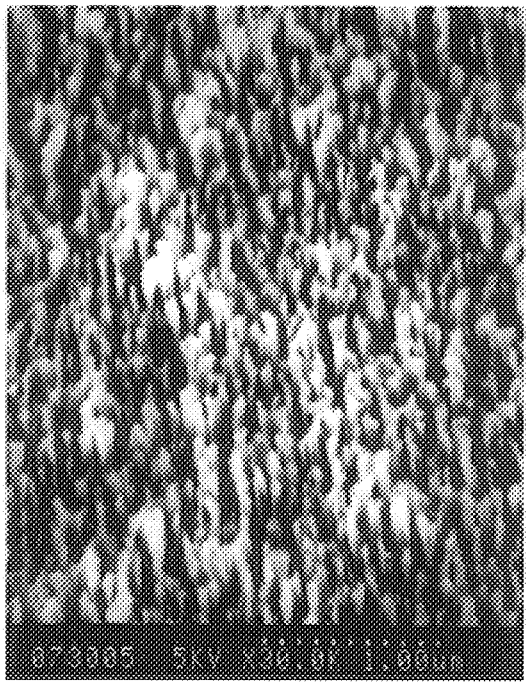
FIG. 5B is a SEM photograph, perspectively showing the diamond protuberances.

FIGS. 3 and 4 are the photographs of diamond surfaces during etching, by scanning electron microscope (SEM). FIG. 3 represents a diamond surface of an initial etch stage, in which the inter-grain boundaries are seen. FIG. 4 represents the diamond surface on which selective etch have been considerably proceeded. The SEM photograph shows that there are a number of etched portion within any single grain. FIG. 5A shows the side view of the resultant diamond protuberances. FIG. 5B also perspectively shows the diamond protuberances. As can be seen in FIGS. 5A and 5B, a number of diamond protuberances have been formed within a very small area. As shown in FIGS. 3, 4, 5A and 5B, very small protuberance dimension having thickness of 0.1 $\mu$m or less was achieved.

Figure 2E:
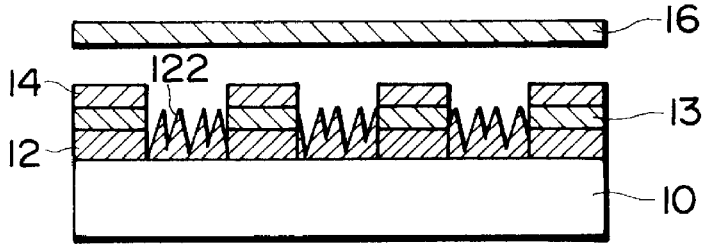
Figure 2F:
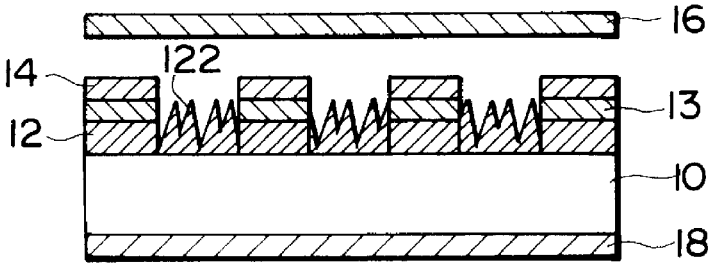

Then, an anode electrode 16 was formed to be spaced 20 $\mu$m apart from the apices of protuberances 122, as shown in FIG. 2E. Backing electrode 18 was then formed on the bottom side of substrate 10, as shown in FIG. 2F. The entire resultant element shown in FIG. 2F was sealed within a vacuum container to provide a field emission device having diamond filed emitter, which comprises a large number of electron emitting protuberances.

Figure 6:
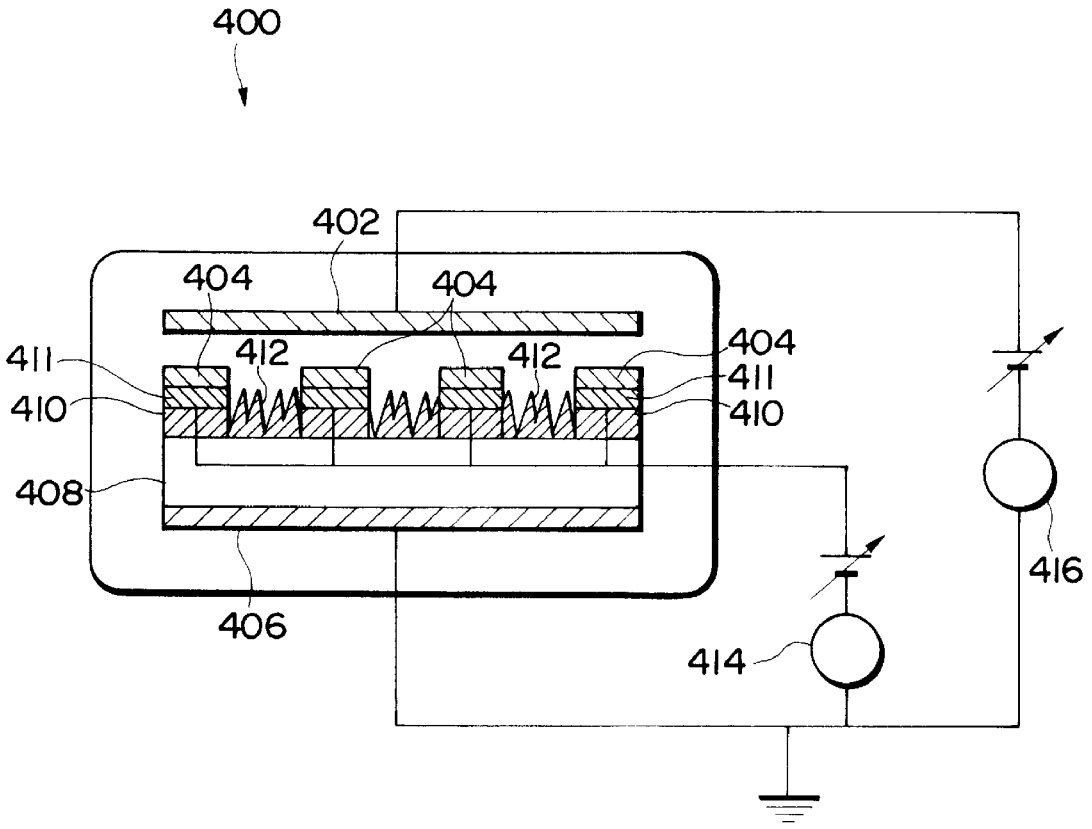
FIG. 6 is a schematic representation of electric circuit for measurements on operation characteristics of devices.

The operation characteristics of the FED was measured as follows. FIG. 6 is a schematic representation of electric circuit for operation characteristics measurements. As shown in FIG. 6, FED 400 comprises a substrate 408, boron doped diamond layers 410 formed on portions of the substrate surface, field emitters 412 formed on rest of the substrate surface, undoped diamond layers 411 formed on respective doped layers 410, an anode electrode 402 spaced apart from field emitter 412, gate electrodes 404 formed on undoped diamond layer 411, and a base electrode 406 formed on the bottom side of substrate 408. The circuit also comprises electric current meters 414 and 416. Variation of anode current for different gate voltage was measured, when voltage of 100 Volts was applied to anode electrode 402. The obtained relationship of gate voltage with anode current is shown in the graph of FIG. 7.

Figure 7:
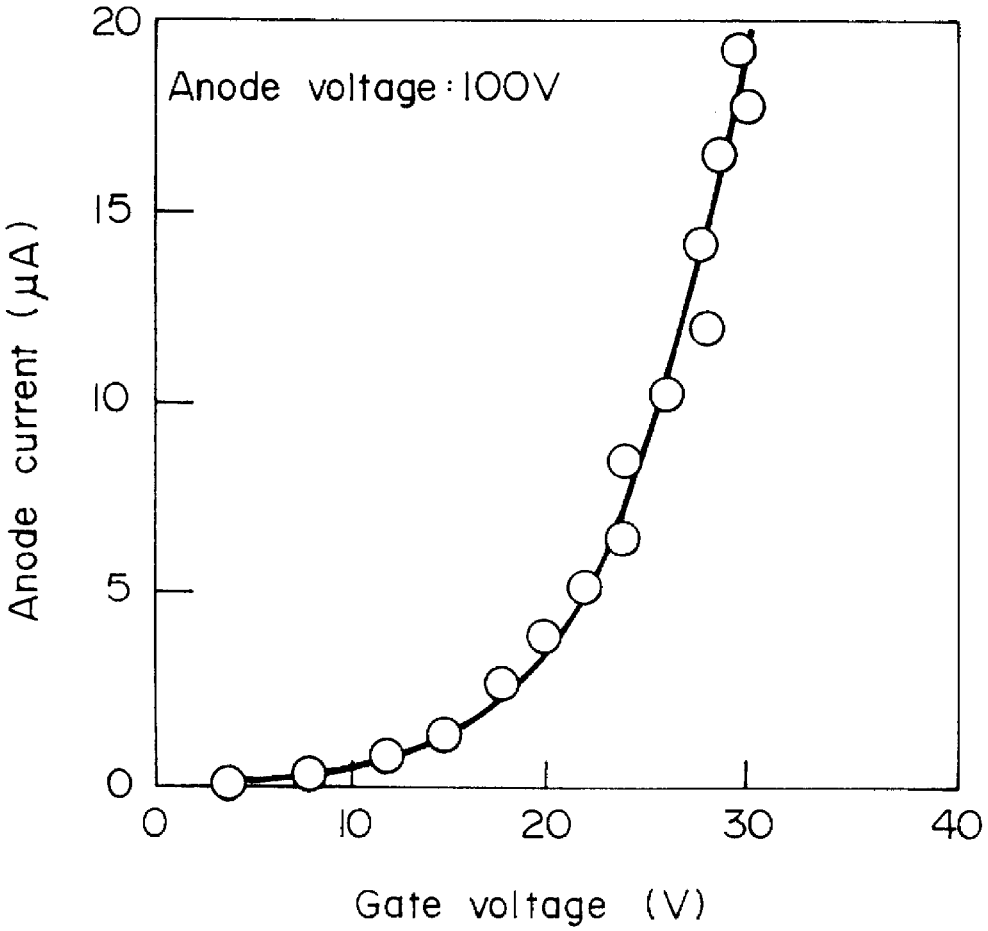
FIG. 7 is a graph showing the relationship of gate voltage with anode current.

As can be seen in FIG. 7, anode current of not less than 1 microampere ($\mu$A) was obtained when gate voltage was relatively lower (10–20 volts).

This example can be modified in various way without departing from the spirit and the scope of the invention. For example, the diamond layers can be formed by using other processes such as thermal filament CVD, ion beam deposition, sputtering, laser ablation, microwave plasma CVD assisted by applying magnetic field or DC discharge plasma CVD. Dopant for doped diamond layer may be nitrogen (N), lithium (Li), phosphorus (P) or arsenic (Ar). Insulations between substrate and gate electrodes can be provided by forming other insulating layer of alternative insulating material such as $SiO_2$.

Example 2

The second example of the present invention illustrates a series of experiments were conducted, in which desirable etch conditions for obtaining "porous diamond", which comprises larger number of thinner diamond protuberances within a prescribed area, are shown. The second example further includes experiments which further comprise the additional etch step with fluorine-containing compound such as hydrofluoric acid (wet) and fluorocarbons (dry), for the purpose of further improving of the sharpness of the electron emission protuberances.

Smaller diameter or thickness of each protuberance provides lower threshold voltage for field emission of the field emitter (porous diamond). It is preferable to provide the porous diamond having diamond protuberances, the thickness of which is 1 $\mu$m or less, and more preferably 0.1 $\mu$m or less, to achieve sufficiently lower threshold voltage for field emission.

Higher protuberance density (number of protuberances in a unit area) provides larger electric current density through the field emission. It is preferable to provide the porous diamond, in which the diamond protuberance density is $1\times10^8$ ($cm^{-2}$) or more, more preferably $1\times10^9$ ($cm^{-2}$) or more, to create sufficiently larger electric current through the field emission.

Figure 8:
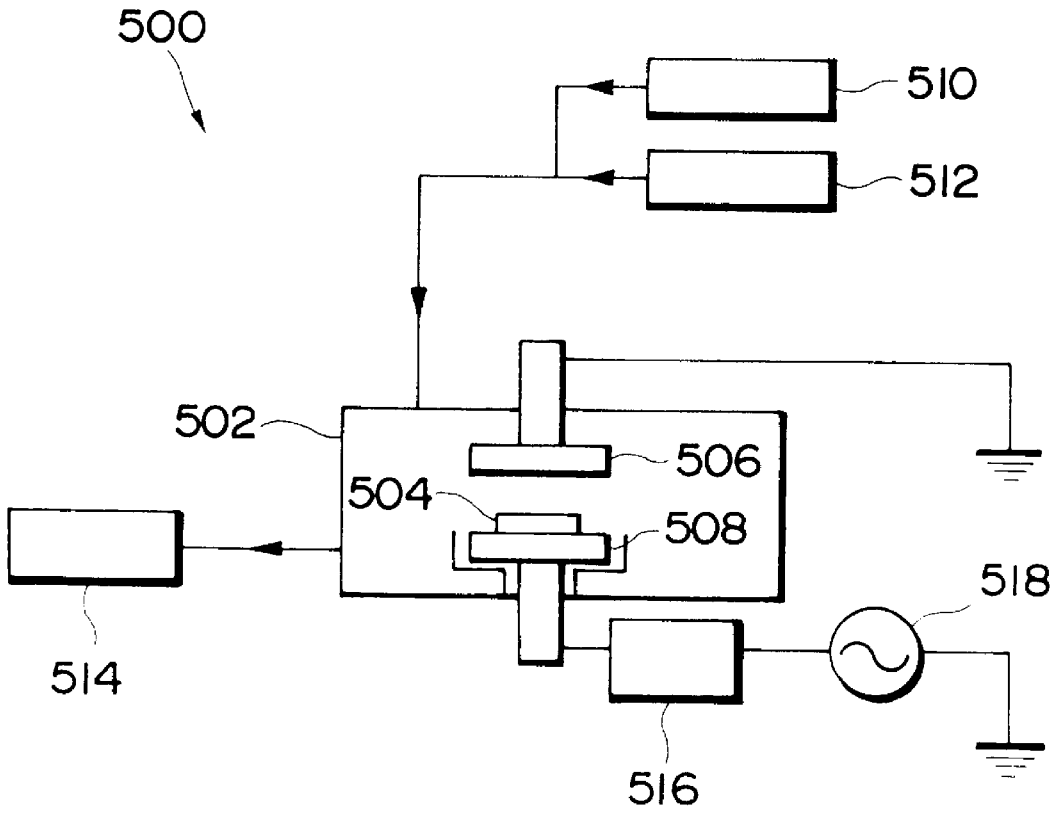
FIG. 8 is a schematic illustration of a plasma etch apparatus used in Example 2.

In this example, dry etch was carried out by using a plasma etch apparatus shown in FIG. 8, which provides reactive ion etching (RIE). As shown in FIG. 8, plasma etch apparatus comprises vacuum chamber 502 in which substrate 504 is mounted on substrate holder (electrode) 508 and plasma is created between electrodes 506 and 508, gas sources 510 and 512 connected to vacuum chamber 502, vacuum pump 514 connected from vacuum chamber 502, and power supply 518 electrically coupled with electrode 508 through matching box 516.

The additional etch step with fluorine-containing compound is effective in further reducing the thickness of the protuberances, because of the following reason: the surfaces of the resulting diamond protuberances which is formed via oxygen plasma etch or nitrogen plasma etch include diamond micro-portions, each of which has considerable number of internal defects. Thus, the additional fluorine-etch can remove such diamond micro-portions to reduce the thickness of each protuberance.

Example 2-1

The example 2-1 illustrates the relationship of the partial pressure of oxygen gas ($O_2$) in the etch gas mixture (mixture of oxygen gas and inert gas) and the number and thickness (diameter) of formed protuberances, when single crystal diamond with nitrogen impurity (Ib diamond) is plasma-etched to produce "porous diamond". Nitrogen impurity acts as internal defects. This example also illustrates the etching of the Ib diamond with oxygen-containing gases such as carbon dioxide ($CO_2$), nitrous oxide ($N_2O$) and carbon monoxide (CO).

Synthesized single crystalline diamond substrate (Ib) having plane orientation of (100) was etched with oxygen-containing plasma to form "porous diamond", which includes a number of diamond protuberances.

The protuberance density (number of protuberances in a unit area) and protuberance tip thickness by etch gases are shown in the following Table-1. The protuberance tip thickness represents the thickness of protuberance.

As shown in Table-1, it was found that etch gases containing 10% vol. of $O_2$ or more provide sufficient protuberance density and thickness. It was also found that the oxygen containing gases provide sufficient protuberance density and thickness.

In order to further improve the thickness of protuberances, further wet etch was carried out for the porous diamond which had been created with the etch gas composed of $O_2$ 100% vol. Wet etch was carried out with HF solution of different HF concentration, and with $HF/HNO_3$ mixture. The obtained protuberance density and tip thickness are shown in Table-2. As can be seen in Table-2, additional fluorine-etch reduces the protuberance tip thickness.

TABLE 1

(etch of Ib diamond)

| Etch gas composition | protuberance density ($cm^{-2}$) | protuberance tip thickness ($\mu m$) |
|---|---|---|
| $O_2$ (100%) | $2\times10^9$ | 0.05 |
| $O_2$(50%)/Ar | $1\times10^9$ | 0.1 |
| $O_2$(10%)/Ar | $3.6\times10^7$ | 0.2 |
| $O_2$(50%)/Kr | $2\times10^8$ | 0.1 |
| $O_2$(50%)/Ne | $1\times10^9$ | 0.07 |
| $O_2$(50%)/He | $2\times10^9$ | 0.05 |
| $CO_2$(100%) | $1\times10^9$ | 0.05 |
| $N_2O$(100%) | $1\times10^9$ | 0.03 |
| CO(100%) | $8\times10^9$ | 0.05 |

*Ar,Kr,Ne and He: inert gas
*% = % vol. , * plasma potential: 10 volts

TABLE 2

| etch solution | protuberance density ($cm^{-2}$) | protuberance tip thickness ($\mu m$) |
|---|---|---|
| HF aq.(50%) | $2\times10^9$ | <0.01 |
| HF aq.(1%) | $2\times10^9$ | 0.01 |
| HF aq.(0.1%) | $2\times10^9$ | 0.01 |
| $HF/HNO_3$ | $2\times10^9$ | 0.01 |

Example 2-2

The example 2-2 illustrates the relationship of the partial pressure of oxygen gas ($O_2$) in the etch gas mixture (mixture of oxygen gas and inert gas) and the number and thickness (diameter) of formed protuberances, when polycrystalline diamond layer is etched to produce "porous diamond".

Polycrystalline diamond layer formed via CVD was etched with oxygen-containing plasma to form "porous diamond", which includes a number of diamond protuberances.

The protuberance density (number of protuberances in a unit area) and protuberance tip thickness by etch gases are shown in the following Table-3.

As shown in Table-3, it was found that etch gases containing 10% of $O_2$ or more provide sufficient protuberance density and thickness. It was also found that the oxygen containing gases provide sufficient protuberance density and thickness.

It was further found that, comparing the result shown in Table-3 with the result shown in Table-1, the porous diamond of Example 2-2 generally has higher protuberance density than that of Example 2-1, because the polycrystalline diamond has larger number of internal defects at which etching proceeds, than Ib diamond.

As shown in example 2-1, further wet etch was carried out for the porous diamond which had been created with the etch gas composed of $O_2$ 100% vol. The obtained protuberance density and tip thickness are shown in Table-4. As can be seen in Table-4, additional fluorine-etch reduces the protuberance tip thickness.

TABLE 3

(etch of polycrystalline diamond)

| Etch gas composition | protuberance density ($cm^{-2}$) | protuberance tip thickness ($\mu m$) |
|---|---|---|
| $O_2$ (100%) | $1 \times 10^{10}$ | 0.05 |
| $O_2$(50%)/Ar | $1 \times 10^{9}$ | 0.1 |
| $O_2$(10%)/Ar | $6 \times 10^{8}$ | 0.2 |

*Ar: inert gas
*plasma potential: 10 volts

TABLE 4

| etch solution | protuberance density ($cm^{-2}$) | protuberance tip thickness ($\mu m$) |
|---|---|---|
| HF aq.(50%) | $1 \times 10^{10}$ | <0.01 |
| HF aq.(1%) | $1 \times 10^{10}$ | <0.01 |
| HF aq.(0.1%) | $1 \times 10^{10}$ | 0.01 |
| HF/$HNO_3$ | $1 \times 10^{10}$ | <0.01 |

Example 2-3

The example 2-2 illustrates the relationship of the partial pressure of nitrogen gas ($N_2$) in the etch gas mixture (mixture of nitrogen gas and inert gas) and the number and the thickness (diameter) of formed protuberances, when single crystalline diamond layer is etched to produce "porous diamond".

Synthesized single crystalline diamond substrate (Ib) having plane orientation of (100) was etched with nitrogen-containing plasma to form "porous diamond", which includes a number of diamond protuberances. This example also illustrates the etching of the single crystalline diamond with nitrogen-containing gases such as ammonia ($NH_3$) and nitrous oxide ($N_2O$).

The protuberance density (number of protuberances in a unit area) and protuberance diameter for etch gas are shown in the following Table-5.

As shown in Table-5, it was found that etch gases containing 10% vol. or more of $N_2$ provide sufficient protuberance density and thickness. It was also found that the nitrogen-containing gases provide sufficient protuberance density and thickness.

TABLE 5

(etch of Ib diamond)

| Etch gas composition | protuberance density ($cm^{-2}$) | protuberance tip thickness ($\mu m$) |
|---|---|---|
| $N_2$ (100%) | $1 \times 10^{9}$ | 0.04 |
| $N_2$(50%)/Ar | $8 \times 10^{8}$ | 0.06 |
| $N_2$(10%)/Ar | $5 \times 10^{8}$ | 0.08 |
| $N_2$(50%)/Kr | $1 \times 10^{9}$ | 0.05 |
| $N_2$(50%)/Ne | $5 \times 10^{8}$ | 0.03 |
| $N_2$(50%)/He | $2 \times 10^{8}$ | 0.02 |
| $NH_3$(100%) | $5 \times 10^{8}$ | 0.08 |
| $N_2O$(100%) | $1 \times 10^{9}$ | 0.03 |

*Ar,Kr,Ne and He: inert gas
*plasma potential: 10 volts

Example 2-4

In example 2-4, the additional fluorine etch step was carried out via fluorine-containing plasma dry etch, without using HF aq. wet etch. The fluorine-etch gas used was carbon tetrafluoride ($CF_4$), trifluoromethane ($CHF_3$) or sulfur hexafluoride ($SF_6$).

The additional dry etch was carried out for the porous diamond, which had been obtained as shown in Example 2-1 with the etch gas composed of $O_2$ 100%. The obtained protuberance density and thickness are shown in Table-6. As can be seen in Table-6, additional dry fluorine-plasma etch reduces the protuberance tip thickness.

TABLE 6

| etch gas | protuberance density ($cm^{-2}$) | protuberance tip thickness ($\mu m$) |
|---|---|---|
| $CF_4$(100%) | $2 \times 10^{9}$ | <0.01 |
| $CHF_3$(100%) | $2 \times 10^{9}$ | 0.01 |
| $SF_6$(100%) | $2 \times 10^{9}$ | 0.01 |

Example 2-5

In Example 2-5, bias voltage was applied to substrate holder, when the first plasma etch step with $O_2$ (100%) gas was conducted. This example includes no additional fluorine etch step.

The result of the density and the thickness of the protuberances are shown in Table 7. As can be seen in Table 7, biasing is effective to obtain thinner protuberances by single oxygen-plasma etch step.

It was also found that the similar effect of biasing was obtained when etch gas containing nitrogen gas ($N_2$) was used.

TABLE 7

| Bias voltage (V) | protuberance density ($cm^{-2}$) | protuberance tip thickness ($\mu m$) |
|---|---|---|
| 0 | $2 \times 10^{9}$ | 0.05 |
| 50 | $1 \times 10^{9}$ | <0.01 |
| 100 | $1 \times 10^{9}$ | <0.01 |

*Etch gas: $O_2$ (100% vol.)

Although the present invention has been described in considerable detail with reference to certain preferred versions, many other versions should be apparent to those skilled in the art. Therefore, the spirit and the scope of the appended claims should not be limited to the description of the preferred versions contained herein.

The basic Japanese Applications No. 5-238,571 filed on Sep. 24, 1993, and No. 7-211,089 filed on Jul. 27, 1995 are hereby incorporated by reference.

What is claimed is:

1. A field emission device comprising:

a support substrate;

a base electrode disposed on a surface of said support substrate;

a first substantially undoped diamond portion disposed on a second doped diamond portion, said first diamond portion including substantially no electron-emitting protuberance;

said second diamond portion disposed on said support substrate surface, said second diamond portion including a plurality of electron-emitting protuberance upon which no first diamond portion is disposed, and being electrically coupled to said base electrode; and an anode positioned space apart from said first and second diamond portions.

2. A field emission device according to claim 1, wherein said protuberance has a dimension that is included within a virtual cylinder having diameter of 1 $\mu$m and height of 5 $\mu$m.

3. A field emission device according to claim 1, wherein said second diamond portion is formed to have said protuberances by selectively etching a diamond surface at internal defects.

4. A field emission device according to claim 1, wherein said second diamond portion is formed to have said protuberances by selectively etching a polycrystalline diamond surface, wherein the etching occurs at internal defects exposed on said polycrystalline diamond surface.

5. A field emission device according to claim 1, wherein said protuberance has a thickness of 0.1 $\mu$m or less.

6. The field emission device according to claim 1, further comprising an electrode disposed on said first diamond portion.

7. A field emission device comprising:

a support substrate;

a base electrode disposed on a surface of said support substrate;

a first diamond portion disposed on a second diamond portion wherein said first diamond portion has a different doping concentration from said second diamond portion, said first diamond portion including substantially no electron-emitting protuberance;

said second diamond portion disposed on said support substrate surface, said second diamond portion including a plurality of electron-emitting protuberance upon which no first diamond portion is disposed, and being electrically coupled to said base electrode; and an anode positioned space apart from said first and second diamond portions.

8. The field emission device according to claim 7, further comprising an electrode disposed on said first diamond portion.

* * * * *